US006820770B2

(12) United States Patent
Makino et al.

(10) Patent No.: US 6,820,770 B2
(45) Date of Patent: Nov. 23, 2004

(54) DISPENSER HOLDER FOR VEHICLES

(75) Inventors: Yon Makino, Phoenix, AZ (US); Patrick Marcanio, Scottsdale, AZ (US); Andrew Seys, Scottsdale, AZ (US); Brad Fulgum, Tempe, AZ (US); Rickie Althouse, Scottsdale, AZ (US); John Bauer, Scottsdale, AZ (US)

(73) Assignee: The Dial Corporation, Scottsdale, AZ (US)

( * ) Notice: Subject to any disclaimer, the term of this patent is extended or adjusted under 35 U.S.C. 154(b) by 0 days.

(21) Appl. No.: 10/313,137

(22) Filed: Dec. 6, 2002

(65) Prior Publication Data

US 2004/0108337 A1 Jun. 10, 2004

(51) Int. Cl.[7] ..... B67D 5/06
(52) U.S. Cl. ..... 222/180; 222/680; 248/154
(58) Field of Search ..... 222/180–184, 222/608–612; 248/154, 313

(56) References Cited

U.S. PATENT DOCUMENTS

| | | | | | |
|---|---|---|---|---|---|
| 2,981,445 | A | * | 4/1961 | Russell | 222/259 |
| 3,032,081 | A | * | 5/1962 | La Cotta | 141/362 |
| 4,570,835 | A | * | 2/1986 | Criqui et al. | 224/414 |
| 4,651,902 | A | * | 3/1987 | Hobbs et al. | 222/153.09 |
| 4,887,784 | A | * | 12/1989 | Kayali | 248/311.2 |
| 5,148,948 | A | | 9/1992 | Granville et al. | |
| 5,167,392 | A | * | 12/1992 | Henricksen | 248/311.2 |
| 5,240,147 | A | | 8/1993 | Frazier et al. | |
| 5,370,060 | A | * | 12/1994 | Wang | 108/44 |
| 5,971,335 | A | | 10/1999 | Perrin et al. | |

FOREIGN PATENT DOCUMENTS

| | | | | |
|---|---|---|---|---|
| DE | 3241 146 A1 | * | 5/1983 | 222/180 |
| DE | 44 01 958 | | 7/1995 | |
| FR | 2 772 583 | | 6/1999 | |
| WO | WO 93/10422 | * | 5/1993 | G01F/11/08 |

* cited by examiner

*Primary Examiner*—Kenneth Bomberg
*Assistant Examiner*—Melvin A. Cartagena
(74) *Attorney, Agent, or Firm*—Snell & Wilmer L.L.P.

(57) ABSTRACT

A holder for a pump-type bottle dispenser includes a base section and an adjustable section capable of moving with respect to each other to adapt to dispenser size and/or shape. The adjustable section suitably includes a neck or other extension that supports the neck of the dispenser, and the bottom of the dispenser rests upon the base member as appropriate. The adjustable section is held in place with respect to the base section by a locking mechanism that may include teeth or other extensions on one of the sections that interface with indentations in the other section to provide a lock against further movement. A post or other support may also be provided to secure the holder against a sink, countertop or other support. Such a holder is particularly useful for soap dispensers and the like which may be provided in public facilities such as vehicle lavatories.

5 Claims, 5 Drawing Sheets

DISPENSER HOLDER FOR VEHICLES

FIELD OF INVENTION

This invention generally relates to holders for pump-type bottles, and more particularly to a bottle holder for use on a moving vehicle such as an aircraft.

BACKGROUND OF THE INVENTION

Recently, liquid hand soaps have become increasingly popular as consumers recognize the convenience, comfort and effectiveness of liquid soaps as compared to bar soaps. Liquid soaps are especially desirable in public facilities, where dispensed liquid soaps are generally more sanitary than shared bar soaps. Liquid soaps are typically dispensed using a pump-type or other suitable dispenser, as may be readily found in public and private restrooms throughout the country. One common type of soap dispenser includes a bottle portion that acts as a reservoir for soap that is provided via a pump-type dispenser. Liquid hand soaps and pump-type dispensers are provided by the Dial Corporation of Scottsdale, Ariz., and by other vendors.

Hand soaps have also become widely-used in lavatories for certain vehicles, including aircraft, buses, watercraft and the like. Frequently, the confined space of a vehicle lavatory restricts the use of large, commercial-type soap dispensers. It is not generally practical to re-design the lavatory to accommodate a large integrated dispenser, since aircraft design changes typically require airworthiness certification by the Federal Aviation Authority (FAA) or another governing body. Accordingly, conventional pump-type soap dispensers are commonly used in many aircraft lavatories. Although such dispensers are compact and readily available, conventional bottle-type dispensers are typically relatively difficult to anchor to the surrounding facilities. Accordingly, the dispenser may easily become misplaced or stolen.

Accordingly, it is desirable to provide a holder to maintain the dispenser in a desired position. Such a holder should be easy to fabricate and install in the aircraft, should be readily implemented in existing lavatories and should be adjustable to accommodate bottles and/or dispensers of various sizes.

SUMMARY OF THE INVENTION

In accordance with various exemplary embodiments of the present invention, a holder for a pump-type bottle dispenser includes a base section and an adjustable section capable of moving with respect to each other to adapt to dispenser size and/or shape. The adjustable section suitably includes a neck or other extension that supports the neck of the dispenser, and the bottom of the dispenser rests upon the base member as appropriate. The adjustable section is held in place with respect to the base section by a locking mechanism that may include teeth or other extensions on one of the sections that interface with indentations in the other section to provide a lock against further movement. A post or other support may also be provided to secure the holder against a sink, countertop or other support.

These and other aspects of the invention shall become more apparent when read in conjunction with the accompanying drawing figures and the attached detailed description of exemplary embodiments.

BRIEF DESCRIPTION OF THE DRAWING FIGURES

The features and advantages of the present invention are hereinafter described in the following detailed description of exemplary embodiments to be read in conjunction with the accompanying drawing figures, wherein like reference numerals are used to identify the same or similar parts in the similar views, and:

DETAILED DESCRIPTION OF EXEMPLARY EMBODIMENTS

The following description is of exemplary embodiments of the invention only, and is not intended to limit the scope, applicability or configuration of the invention in any way. Rather, the following description is intended to provide a convenient illustration for implementing various embodiments of the invention. As will become apparent, various changes may be made in the function and arrangement of the elements described in these embodiments without departing from the scope of the invention as set forth herein.

For example, in the context of the present invention, the method and apparatus hereof may find particular use in connection with liquid hand soap dispensers. However, generally speaking, various other products and dispensers (such as soap, hand sanitizer, lotion, shampoo, toothpaste, mouthwash, beverages, and/or other fluids capable of being dispensed by pump, aerosol, spray-type or other dispensers) are suitable for use in accordance with the present invention. Accordingly, the terms "bottle" and "dispenser" as used herein are intended to interchangeably refer to any holding device, reservoir or other retaining vessel capable of holding and/or dispensing any fluid such as those previously recited. Moreover, the exemplary embodiments may be described herein using relative spatial descriptors such as "vertical", "horizontal", "above", "below" and the like. These terms are used solely to allow ease of understanding, and are not meant to limit the invention to any particular spatial orientation or layout. In this context, various embodiments of the present invention may be described herein in conjunction with specific devices or products and it should be appreciated that the scope of the present invention should not be considered limited to those specifically mentioned herein.

In accordance with the present invention, a holder is capable of securely maintaining a dispenser in a desired position, and may be further capable of adapting to dispensers of varying sizes and dimensions. As used herein "adaptable" refers to the ability to adjust to fit differently sized or shaped bottles, and as such, shall be synonymous with "adjustable" and other like-meaning terms.

Figure 1:
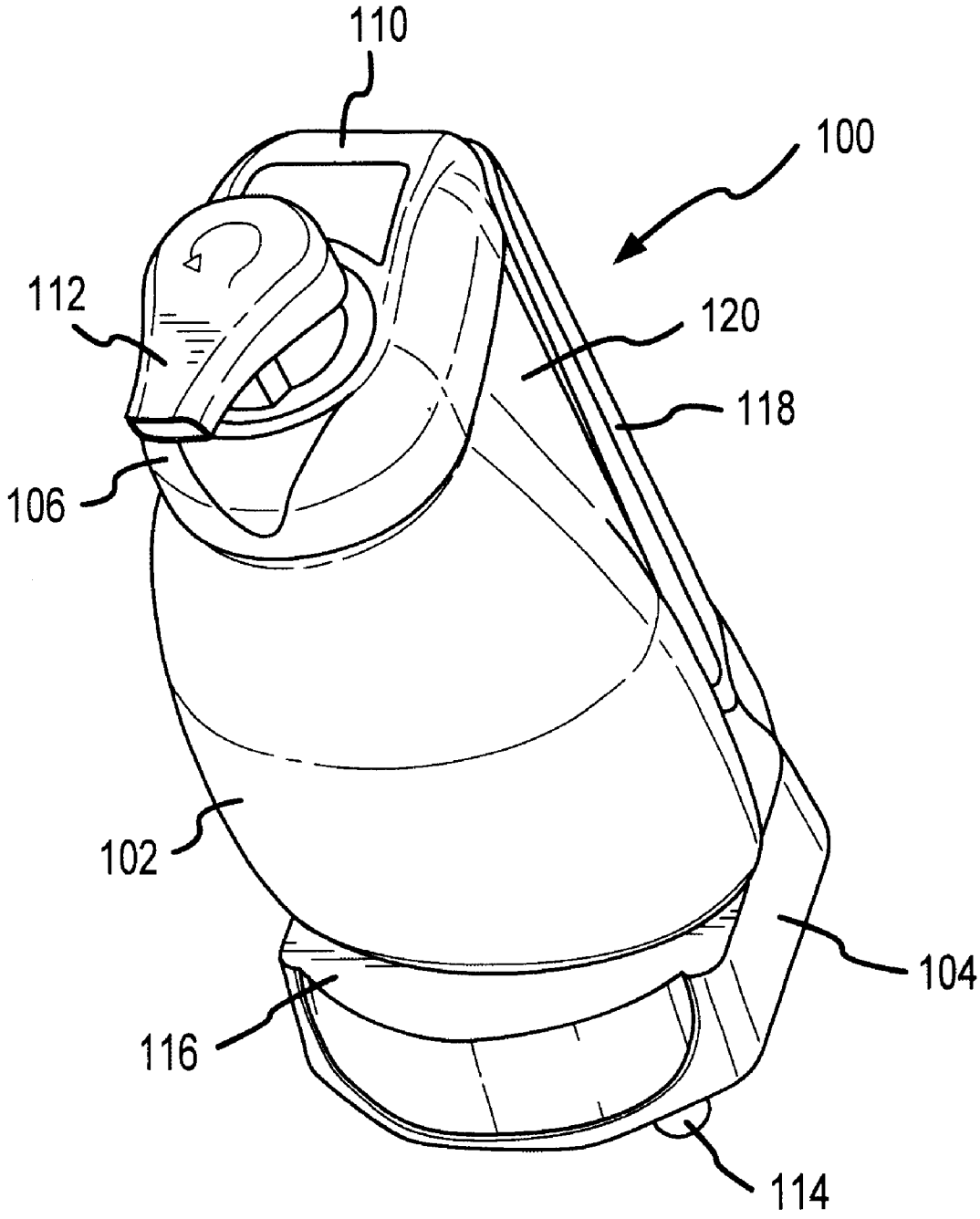
FIG. 1 is a front perspective view of an exemplary holder for a bottle-type dispenser.

With reference now to FIG. 1, an exemplary holder 100 for a dispenser 102 suitably includes an adjustable section 110 that adapts with respect to a base section 104 to accommodate dispensers 102 of varying sizes. The entire holder assembly 100 may be bolted, welded or otherwise fixed to a countertop or other appropriate structure using an optional support post 114, which suitably interfaces with an opening or other recession in the countertop. Each of the components of holder 100 may be readily fashioned from plastic, metal, ceramic, glass and/or the like using any conventional technique, such as injection molding or thermoforming.

Base section 104 suitably includes a base surface 116 that supports the bottom surface or other base portion of dispenser 102. Various embodiments of base section 104 also include a vertical portion 118 that projects substantially perpendicular to base surface 116 to support adjustable section 110 as appropriate. By "substantially", it is intended that the actual direction of projection may not be exactly perpendicular, but may vary by as much as 30 degrees or more in any direction to accommodate defects, design choices, ergonomic concerns and the like. In various embodiments, vertical portion 118 includes any number of posts, guide rails or other supports to guide the vertical movement of adjustable section 110. Vertical portion 118 may also include one or more teeth, outcroppings or other portions of a locking mechanism as described more fully below.

Adjustable section 110 suitably includes a substantially vertical support section 120 and a neck 106 or other receiving end capable of receiving and supporting the neck or pump head portion 112 of dispenser 102. In an exemplary embodiment, neck 106 laterally projects from vertical support section 120 to form a circular, elliptical or other support circumscribing the neck portion 112 of dispenser 102.

To place dispenser 102 in holder 100, a user inserts nozzle 112 of dispenser 102 through an opening in neck 106. The user then positions the bottom of dispenser 102 against base 116 to prevent further movement. Accordingly, dispenser 102 is restrained from movement in the vertical direction by base 116, and is restrained in the horizontal directions by neck 106. In a further embodiment, adjustable section 110 is configured to move in the vertical direction with respect to base 116 through any sort of slide, lock and/or hinge mechanism to adapt to dispensers 102 of varying shapes and sizes, as described more fully below. In an alternate embodiment, however, adjustable portion 110 may be omitted entirely, combined with base portion 104 in any manner, or may be rigidly fixed with respect to base portion 104. In yet another embodiment, the vertical portions 118 and 120 of base section 104 and adjustable section 110 (respectively) may be combined into a single structure. Accordingly, adaptive movement of holder 100 is an optional feature that is not required in all embodiments.

Figure 2:
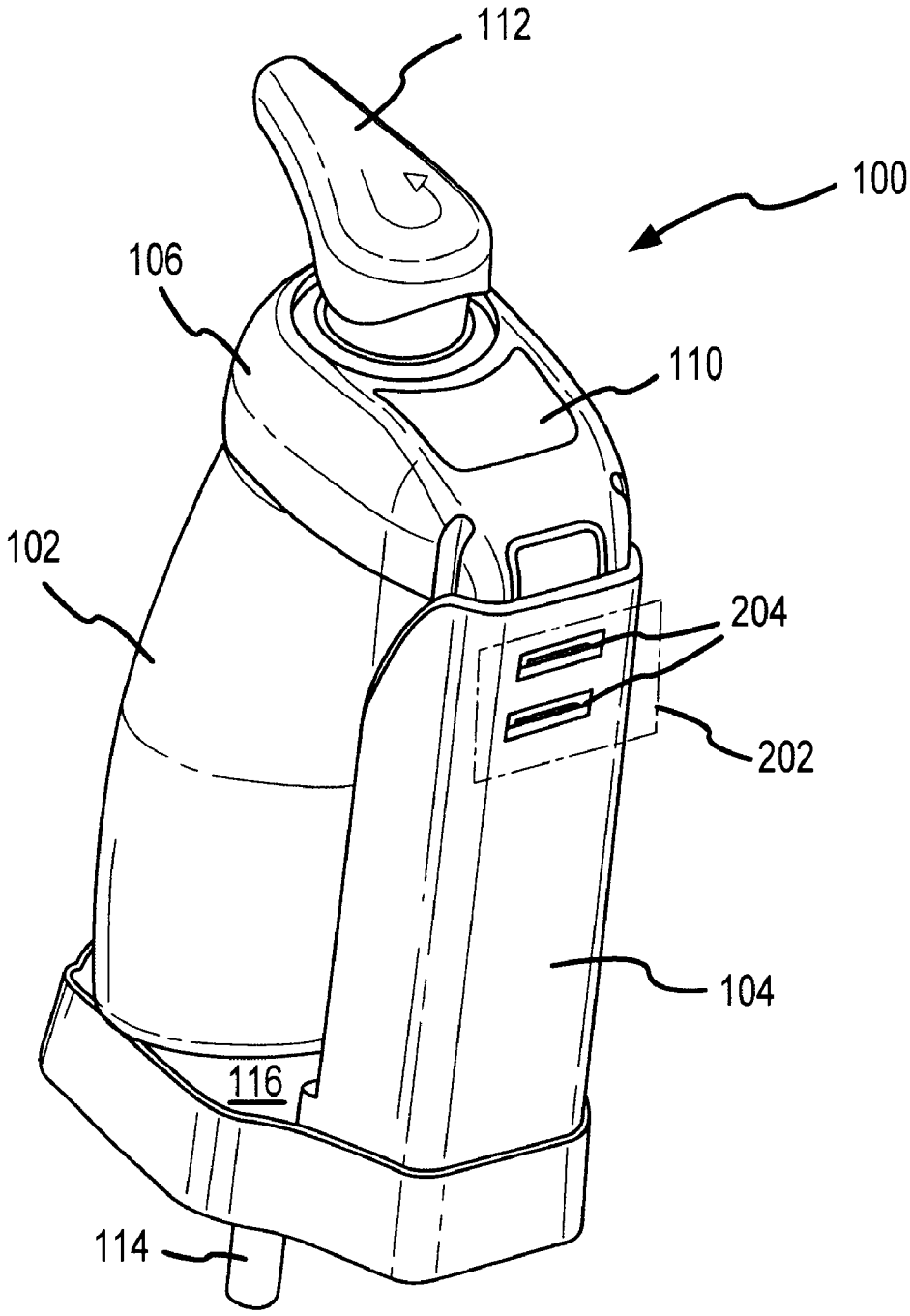
FIG. 2 is a back perspective view of an exemplary holder for a bottle-type dispenser.

With reference to FIG. 2, an exemplary holder 100 with an adaptable locking mechanism 202 is shown. Locking mechanism 202 suitably allows adjustable section 110 to move relative to base section 104 as appropriate, while retaining adjustable section 110 in a desired position to accommodate dispensers 102 of various shape and size. In an exemplary embodiment, locking mechanism 202 is implemented by placing divots, openings, recessions or other receiving elements in one of the sections 104 or 110, and by placing corresponding teeth or outcroppings that on the other section such that the teeth mate with the receiving portions to hold the two members 104/110 in place with respect to each other. In the exemplary holder 100 shown in FIG. 2, a tooth or other outcropping attached to base section 104 is received in any of the openings 204 formed in adjustable portion 110. By sliding the tooth between the various openings 204, the height of holder 100 can be readily adapted to accommodate dispensers 102 of various sizes. Additional detail about locking mechanism 202 is described in conjunction with FIG. 4 below. In an alternate embodiment, the locking teeth could be placed on base section 104 and recessions could be placed in adjustable portion 110, or a portion of both teeth and recessions could be placed on each of the two sections. In still other embodiments, recessions may be eliminated and various outcroppings or teeth on either or both sections could provide enough friction to maintain the two sections relatively stationary with respect to each other. Additionally, any type of key-based locking mechanism may be provided such that a key is required to separate and/or move adjustable section 110 with respect to base section 104.

Figure 3:
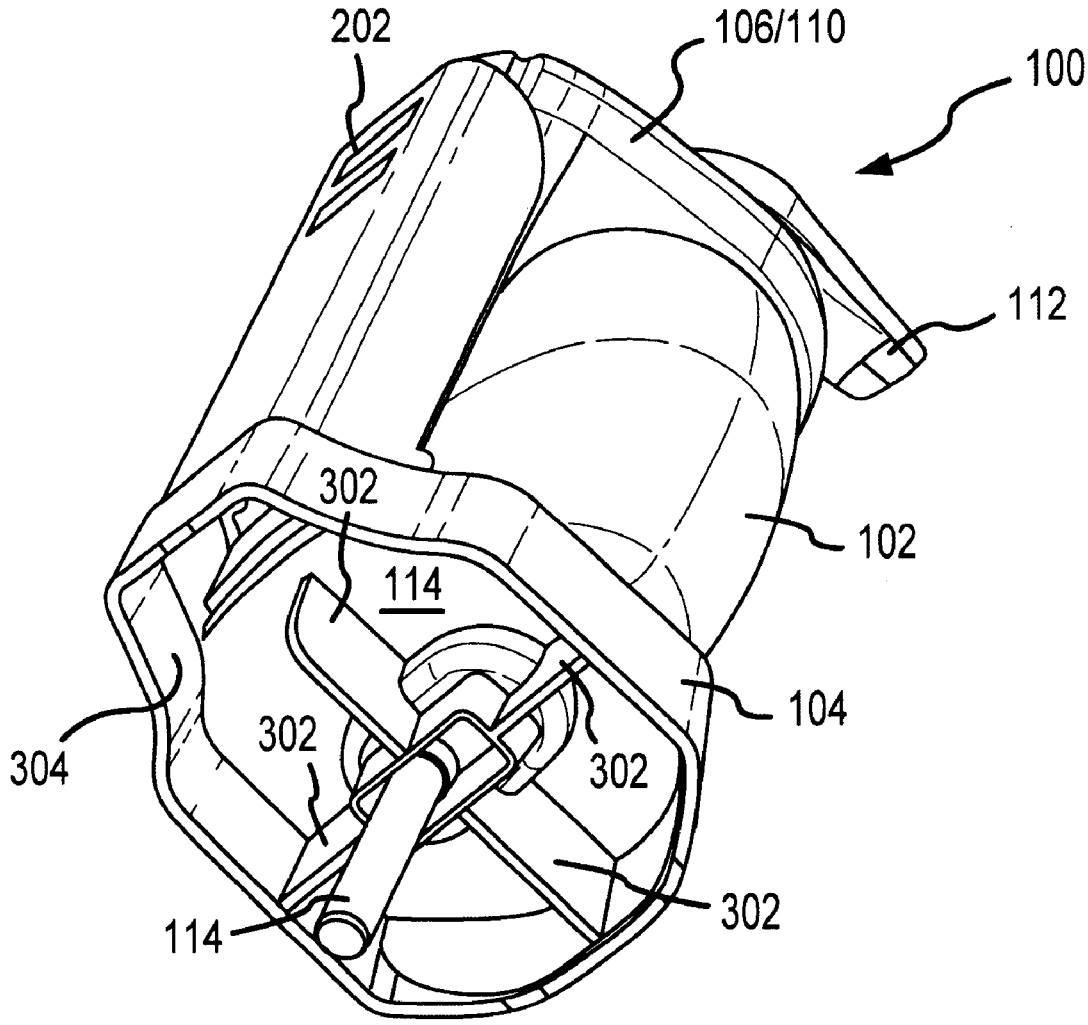
FIG. 3 is a bottom perspective view of an exemplary holder for a bottle-type dispenser.

Referring now to FIG. 3, base section 104 of holder 100 may be fashioned with an exterior ridge 304 supporting base 116 above the counter or other surrounding surface. Any number of wing supports 302 may also be provided, as shown in the figure. Ridge 304 and supports 302 may be integrally formed with base section 104 during injection molding, for example, or may be formed as separate components that are affixed to base section 104 with an epoxy or other adhesive, with a plastic weld, or through any other appropriate technique. Alternatively, ridge 304 and/or supports 302 may be eliminated, or base section 104 may be formed as a solid body through molding or any other technique.

An optional support post 114 may be similarly formed on or otherwise affixed to base 116 though plastic welding, molding, adhesives, or the like. Post 114 may be rigidly affixed to holder 100 to assist in securing holder 100 to a sink, counter or other support surface as appropriate. In alternate embodiments, portions of post 114 may be threaded to accept a bolt, nut and/or washer assembly, or with a hole for accepting a lock pin, toggle or the like.

Figure 4:
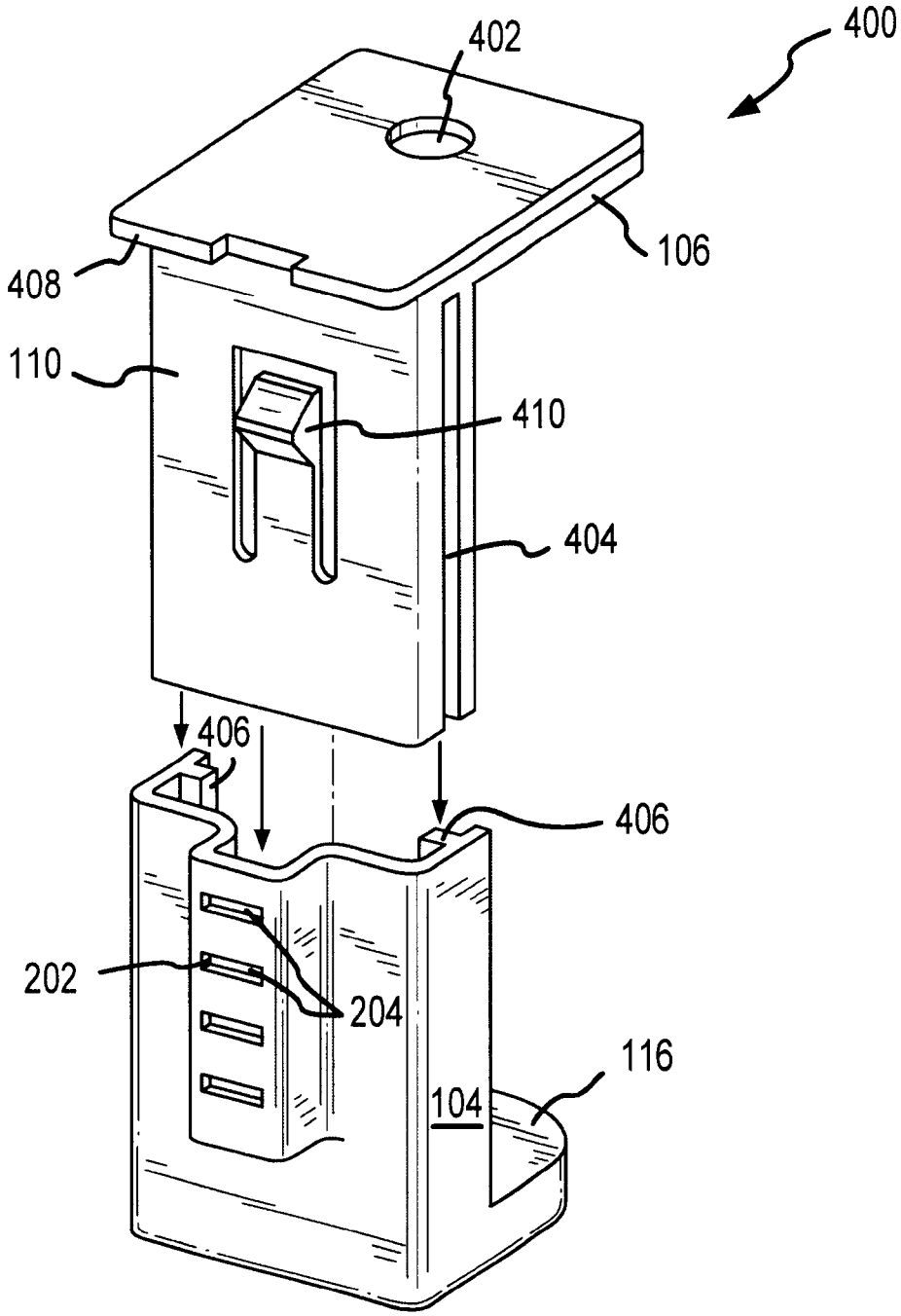
FIG. 4 is an exploded view of an exemplary holder for a bottle-type dispenser.

Referring now to FIG. 4, an optional further embodiment of a holder 400 suitably includes a guide-and-post structure to assist vertical movement of the adjustable section 110 with respect to base section 104. In the embodiment shown in the Figure, two guide rails 406 are formed on base section 104 that are sized to slideably mate with guide channels 404 formed in adjustable section 110. As adjustable section 110 moves vertically with respect to base section 104, rails 404 suitably remain within channels 404 to prevent undesired lateral movement, thereby improving the overall stability of holder 100. Of course, many variations of the guide-and-post concept could be implemented in other embodiments. Rails 406 could be alternately formed as posts, for example, or the relative positions of rails 406 and channels 404 could be reversed.

FIG. 4 also shows an optional locking mechanism 202 that includes a post 410 interfacing with any of several openings 204 provided on base section 104. As adjustable section 110 slides within guides 404, post 410 suitably mates with one of the openings 204 to provide enough friction to maintain adjustable section 110 in a desired position. When locking mechanism 202 is disengaged, for example, through the pressing of a button, the retention force provided by post 410 against openings 204 may be readily overcome by applying vertical force in either direction to slide adjustable section 110 as desired. Adjustable section 110 may also be formed with a lip or overhang 408 that contacts the uppermost face of base section 104 to prevent over-sliding. Adjustable section 110 is further formed with neck 106 and opening 402 for retaining the neck of bottle 102 (FIG. 1) as appropriate.

Figure 5:
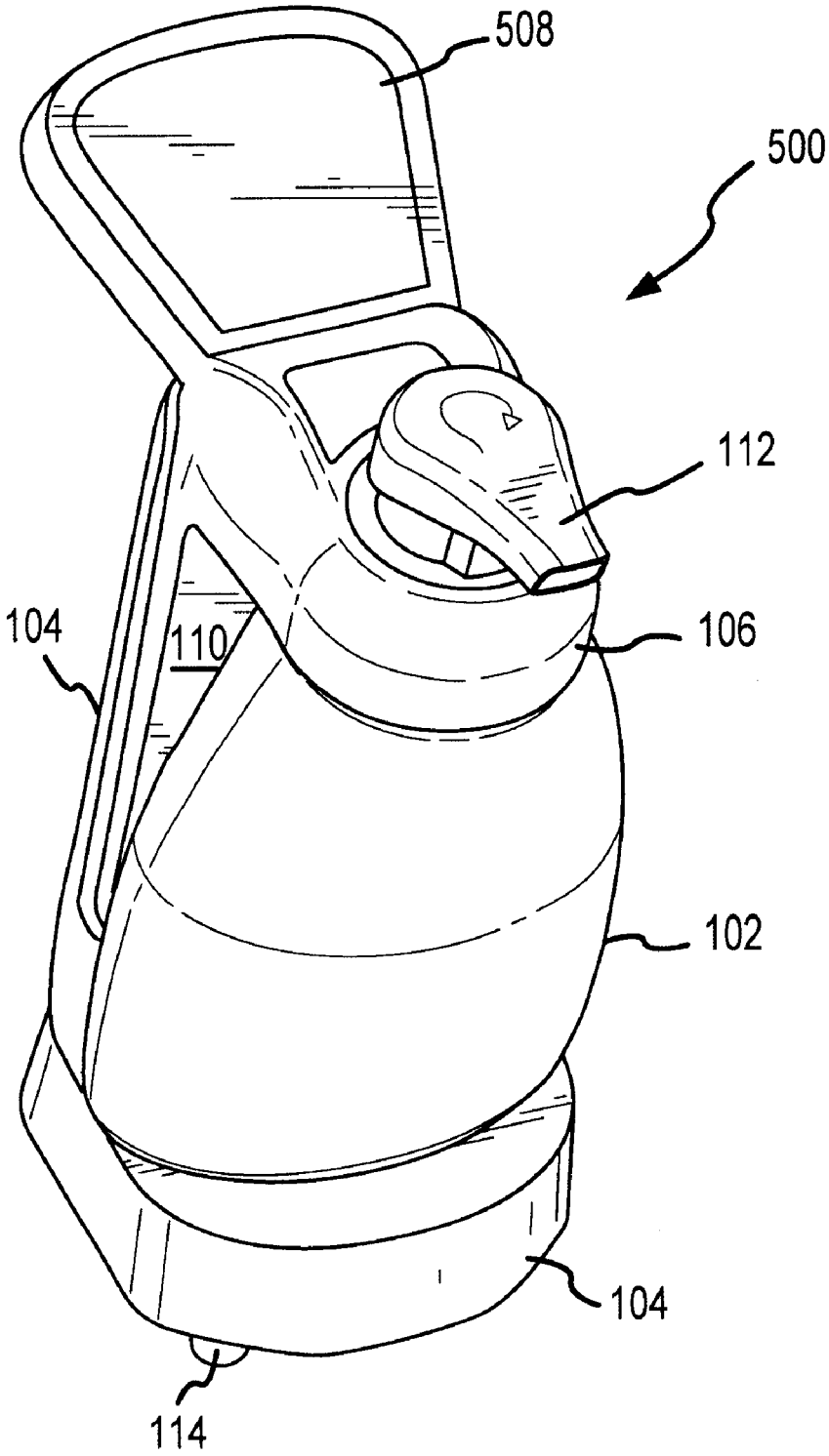
FIG. 5 is a perspective view of an exemplary holder that includes a display placard.

With reference now to FIG. 5, the holder 500 may be further fitted with a placard or other advertising space 508 in any shape or style. Because many people may come into contact with holder 500 in a vehicle lavatory throughout the course of the day, space 508 provides a convenient and effective location for providing an advertising message, particularly a message that is affiliated with a high-quality product being provided by dispenser 102. Of course the shape, style and size of advertising space 508 may vary widely from embodiment to embodiment. For example, in various embodiments, different shaped advertisements may be placed on various portions of holder 100 and dispenser 102, such as base 104 and/or neck 106. Various equivalent structures that could be provided include a cartoon or other ornamental display, a reminder that employees must wash their hands before returning to work, a digital display of any sort (such as a liquid crystal or flat panel display that may be coupled to a digital computer) or the like.

For the sake of brevity, conventional mechanical and industrial design techniques used in developing various devices (and the various components thereof) are not described in detail herein. Accordingly, devices disclosed herein may be readily modified to create equivalent embodiments through application of general mechanical, industrial and/or manufacturing principles. For example, neck portion 106 could be readily modified to include a separate member coupled to adjustable section 110 by a hinge or other mechanism such that the separate member is movable to accommodate the neck of dispenser 102. In such embodiments, neck portion 106 may be configured to "wrap around" the neck of dispenser 102 instead of simply retaining the dispenser in a hole in neck portion 106. Alternatively, neck portion 106 could be implemented with a cloth, rubber, plastic or other extraneous member that "wraps around" the neck of dispenser 102.

The particular implementations shown and described herein are examples of the invention and are not intended to otherwise limit the scope of the invention in any way. In this context, the corresponding structures, materials, acts and equivalents of all elements described herein, are intended to include any structure, material or acts for performing the functions described herein and include those now known or hereafter devised.

What is claimed is:

1. A holder for a dispenser, the holder comprising:

a base section supporting a base of the dispenser configured to attach to a holder support structure; and an adjustable section having a receiving end configured to accept and support a neck of the dispenser, wherein the adjustable section is movable with respect to the base section to accommodate dispensers of varying sizes, and a locking mechanism configured to prevent relative movement between the base section and the adjustable section, and comprising a toot and at least one recession corresponding to the tooth.

2. The holder of claim 1 wherein the adjustable section comprises a neck portion having an opening configured to circumscribe the neck of the dispenser.

3. The holder of claim 1 wherein the tooth is coupled to the adjustable section and the recession is coupled to the base section.

4. The holder of claim 1 further comprising a support post coupled to the base section.

5. The holder of claim 4 wherein the support post is configured to interface with surface.

* * * * *

UNITED STATES PATENT AND TRADEMARK OFFICE

CERTIFICATE OF CORRECTION

PATENT NO. : 6,820,770 B2
DATED : November 23, 2004
INVENTOR(S) : Makino et al.

It is certified that error appears in the above-identified patent and that said Letters Patent is hereby corrected as shown below:

Column 6,
Line 17, change "toot" to -- tooth --

Signed and Sealed this

Third Day of May, 2005

JON W. DUDAS
*Director of the United States Patent and Trademark Office*